United States Patent [19]

Müller et al.

[11] Patent Number: 4,848,059

[45] Date of Patent: Jul. 18, 1989

[54] APPARATUS FOR PACKING A CYLINDRICAL STACK OF DISK-LIKE WORKPIECES

[75] Inventors: Jürgen Müller; Eberhard Halle, both of Braunschweig, Fed. Rep. of Germany

[73] Assignee: Schmalbach-Lubeca AG, Braunschweig, Fed. Rep. of Germany

[21] Appl. No.: 240,256

[22] Filed: Sep. 2, 1988

[30] Foreign Application Priority Data

Sep. 2, 1987 [DE] Fed. Rep. of Germany ..... 3729271

[51] Int. Cl.[4] ..... B65B 11/04; B65B 49/16

[52] U.S. Cl. ..... 53/133; 53/137; 53/532; 53/542; 53/212; 53/254; 53/380

[58] Field of Search ..... 53/137, 532, 542, 254, 53/380, 212, 133

[56] References Cited

U.S. PATENT DOCUMENTS

| | | | |
|---|---|---|---|
| 3,899,864 | 8/1975 | Uchida et al. | 53/212 |
| 4,221,103 | 9/1980 | Uchida | 53/212 |
| 4,282,701 | 8/1981 | Miyazaki et al. | 53/212 X |
| 4,395,864 | 8/1983 | Anderson et al. | 53/532 |
| 4,442,652 | 4/1984 | Wakamatsu et al. | 53/542 X |
| 4,537,550 | 8/1985 | Mojden et al. | 53/532 X |
| 4,625,493 | 12/1986 | Yagi et al. | 53/380 X |
| 4,651,500 | 3/1987 | Chaffey | 53/380 X |
| 4,781,010 | 11/1988 | Furuya et al. | 53/212 X |

*Primary Examiner*—Horace M. Culver

*Attorney, Agent, or Firm*—Herbert Dubno; Ronald Lianides

[57] ABSTRACT

The apparatus for packing cylindrical stacks of a plurality of disk-like workpieces, particularly covers, positioned beside each other with equal numbers of workpieces, in a jacket made of wrapping paper has at least one receiving trough for the stacks and clamping rails movable laterally into a raised position and raisable and lowerable as well as movable toward each other associated with it for transferring the stack into a wrapping station provided laterally beside the receiving trough with drivable supporting rollers for the stack. At least one pressing roll running parallel to the supporting rollers is lowerable in the wrapping station to the stack and a longitudinally movable carriage is provided with a pressure-limiting contacting member for pressing the stack against a fixed support. A carriage-mounted cutter for cutting away the edge of the paper wrapped around the stack is located on the carriage. The carriage and the support are equipped with folding fingers for forming closed rosettes and mechanisms for applying adhesive closing strips to the rosettes.

15 Claims, 15 Drawing Sheets

65
11
65

20
21
43
11
43
21
22

20
21
43
11
24
43
21
22

20
21
24
21
22

Fig.10a
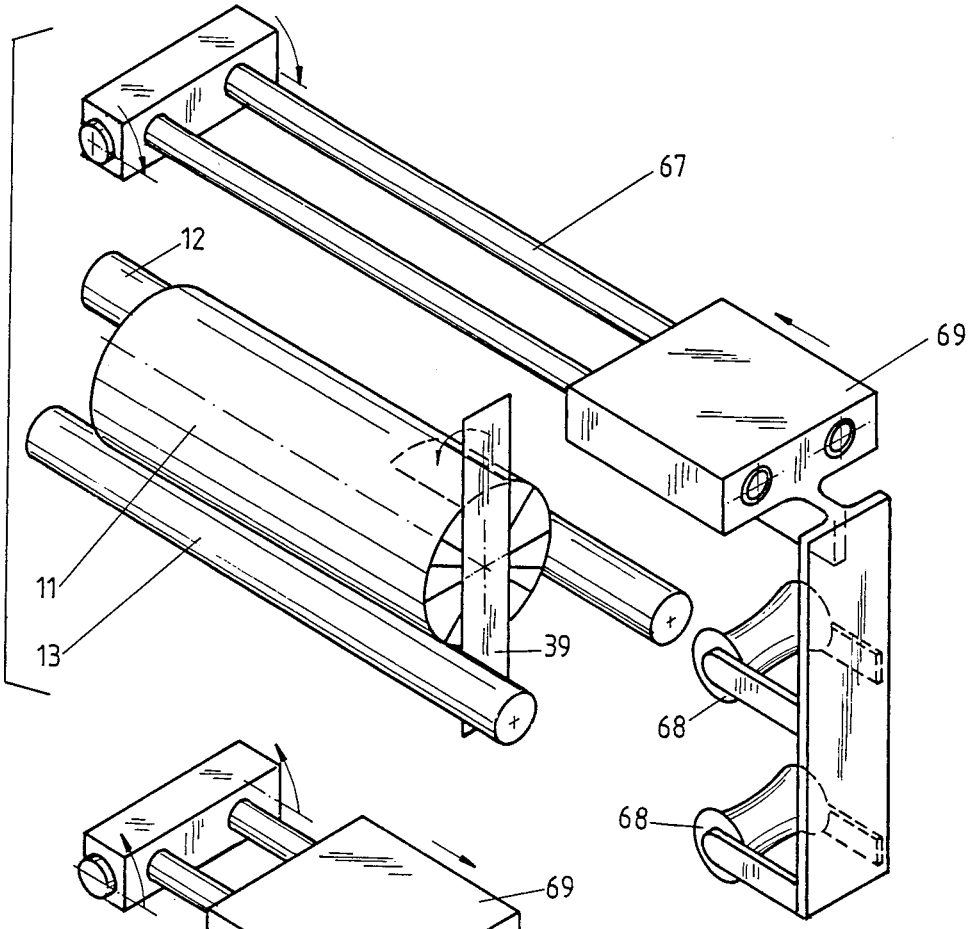
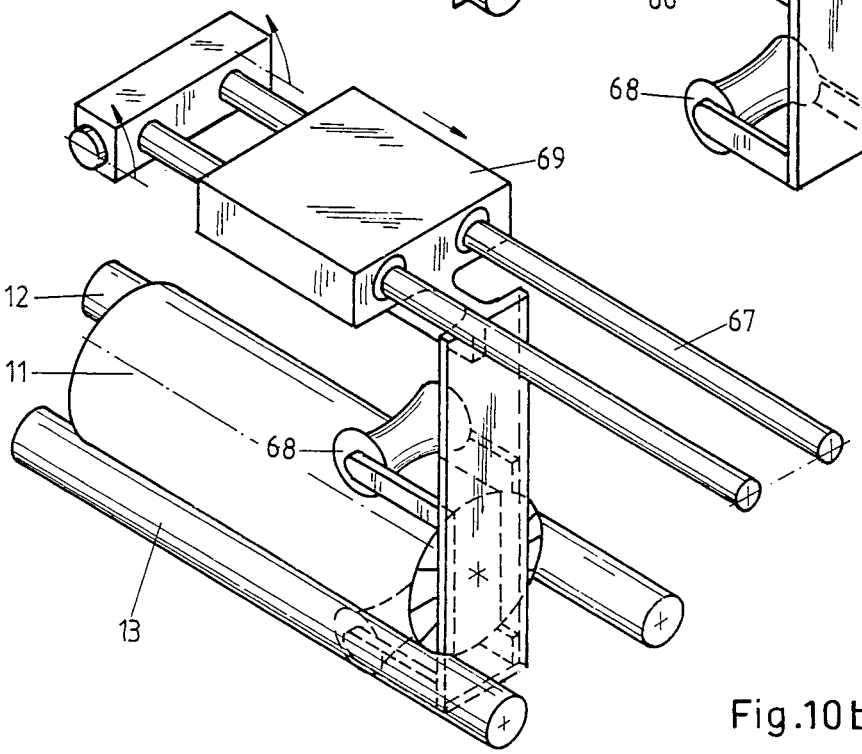
Fig.10b

APPARATUS FOR PACKING A CYLINDRICAL STACK OF DISK-LIKE WORKPIECES

FIELD OF THE INVENTION

Our present invention relates to an apparatus for packing cylindrical stacks comprising a plurality of disk-like workpieces, especially metal covers, in a paper jacket or sleeve.

BACKGROUND OF THE INVENTION

In an apparatus as described in European Patent application No. 206,374, the workpieces are wrapped in a jacket of paper to which the workpieces are conveyed over one or two conveying troughs from associated counters. The apparatus has a wrapping station laterally adjoining the conveying troughs, a mechanism for transferring the stack or stacks to the wrapping station and a folding mechanism for closing the ends of the jacket. It also includes a mechanism for bringing and applying adhesive closing strips to the folded ends of the jacket.

A table is movable transversely to the longitudinal direction of the stack for receiving and transferring a single stack is provided to which the stacks of covers are transferred from a conveyor by a carriage-mounted and guided gripping and clamping device. The movable table with the cover stack on it is moved toward a portion of the wrapping paper which is hanging down and a fixed guide table of the apparatus and pushed on the fixed guide table of the apparatus to form a partially wrapped stack in the paper jacket.

A piece of the paper for jacketing the stack is cut away from the paper sheet and placed around the stack with the help of a pressing member to form the paper jacket. Then an end portion of the wrapped papaer can be provided with an adhesive strip.

The stacks thus wrapped are conveyed further transverse to their longitudinal direction by the following stack being pushed into the winding station and reach folding elements which engage its ends to fold the projecting portion of the paper jacket to form a cross-like end piece after thrusting the stack between locally fixed pressing rails running transversely to the longitudinal direction of the stacks in one step.

The pressing rails simultaneously form guides for the adhesive closing strips on their ends facing the ends of the stacks. The adhesive closing strip is glued on the ends of the stacks and cut through with a knife blade between adjacent stacks.

The known apparatus, because of the laterally movable table and the laterally loaded stationary guide table for receiving of the stacks thrust transversely to their longitudinal direction, is comparatively wide so that because of spatial requirements putting the stack in place during the conveying process, particularly for metal covers, leads to considerable difficulties.

Further considerable efforts or expenses are required for the transfer of the stacks in the wrapping station and the lateral sliding of the movable table.

With covers with a flanged edge because of wear of the flanged material and/or small differences in the deformability of the material, variations in the thickness and/or in the width of the cover edges occur so that with the usual number of covers in each stack length, differences in the stack of up to a few centimeters can occur.

In the known apparatus the rails and/or folding elements provided for the folding process of the protruding ends of the jacket and for the application of the adhesive closing strips must be arranged so that with the length of the stack a maximum the stacks can still be thrust between the rails and folding elements engaging their ends. Thus stacks with different covers pressed together and with jackets engaging about the covers with different tightness result. These differences become disadvantageously noticeable in the inevitable later removal of the covers from the jacket for further processing.

Particularly, with aluminum covers the stacks of the counted covers are so different in length that one of the rails and the associated folding elements cannot be used. When the second end cannot be automatically folded is necessary to fold that end of the protruding paper manually to form the jacket.

OBJECTS OF THE INVENTION

It is an object of our invention to provided an improved apparatus for packing a cylindrical stack of disk-like workpieces so that without significant change of the conveying path of the workpieces a very compact structure in the vicinity of the conveying troughs for the workpieces to be packed results and also a uniform packing density inside the stack is attained with larger differences in the length of the cylindrical stacks.

It is an also object of our invention to provide an improved apparatus for packing a cylindrical stack of disk-like workpieces which can operate essentially automatically despite large differences in the length of the cylindrical stacks.

SUMMARY OF THE INVENTION

According to our invention, a receiving trough or troughs are provided as an extension of the conveying trough or troughs and clamping rails movable toward each other engaging on the stack are raisable and lowerable to transfer the stack to the wrapping station and are maintained laterally movable in a raised position. The wrapping station has drivable supporting rollers for support of the stack and, above the supporting rollers, at least one lowerable press roll running parallel to the supporting rollers on the stack. A carriage movable toward the stack in the wrapping station with a pressure--limiting contacting member for contacting the ends of the stack and for pressing the stack against a stationary support is provided.

The carriage and the stationary support have a carriage--mounted cutter moving with the carriage for cutting the carriage-side edge of the wrapping paper and a plurality of folding fingers for forming closed rosettes of the wrapping paper.

The receiving troughs provided for receipt of the cylindrical stacks in our apparatus allow a facile transfer of the stacks in the vicinity of the clamping rails which are designed to be raisable and lowerable and in the raised position laterally movable to transfer the stacks fed to the apparatus one-at-a-time into a waiting position and to free the receiving trough or troughs of our apparatus for the next stack. Thus variations in the feed of the workpieces to our apparatus, especially at a higher and/or faster speed, are handled without having to adjust the operating speed of the apparatus to the feed of the workpieces to be packed.

Since the wrapping of the stacks is effected directly laterally beside the receiving troughs, a compact structure for our apparatus results so that it can be a part of a conveying system for this kind of disk-like workpiece.

Because of the pressure-limiting contacting sensor movable toward the stack in the wrapping station a uniform packing density of the workpieces inside the stack is attained. With larger tolerances in the thickness of the disk-like workpieces different length dimensions result for the stacks with the same packing density. The wrapping paper is fitted to the stack by the carriage-mounted cutter for cutting away the edge of the wrapping paper movable in a direction parallel to the stack longitudinal direction so that equal closed rosettes arise on each end of the stack. These closed rosettes may be formed and also fixed in the wrapping station during the rotation of the stack with its jacket in the wrapping station with the help of the folding fingers.

The entire design produces a practical wrapping machine in which the stack transferred to the drivable supporting rollers for wrapping is held fixed on it maintaining an axial uniform adjustable forward pressure the same for all the stacks until at the location at which the jacket and the rosettes are put on the stack.

The stacks thus obtained are of a uniform density from which the jacket can be easily removed in later further processing of the workpieces which is not possible when the packing density of the stacks differ. When the stacks are packed too rigidly the jacket can be removed only with difficulty. The stability of the shape of the stacks cannot be guaranteed when they are packed too loosely and thus there are problems both in conveying and removing workpieces from the stacks.

In an especially compact advantageous form of our invention the wrapping station is mounted above the mechanism for rolling out, feeding, cutting (in the longitudinal direction of the stack) and gluing the paper and two mechanisms for applying the adhesive closing strip substantially the same are provided with associated closing strip cutting mechanisms under the stationary support and under the carriage travelling with the carriage. A heavy fresh supply roll of paper can be easily inserted our apparatus because of its deep open structure. The gluing mechanism and the rolling out mechanism for the paper are easily accessible from the exterior in our apparatus. Similarly like the mechanisms provided under the wrapping station the mechanism for application and cutting off the adhesive closing strip is easily accessible from the exterior.

It is especially suitable when the carriage-mounted cutter for cutting off the edge of the wrapping paper is equipped with a perforating tool perforating the paper spaced from and parallel to the edge. Subsequent removal of the jacket for further processing of the workpieces is made considerably easier since the jacket can be torn along the perforations provided spaced from and parallel to the edge of the stack.

Many advantageous forms and features of our invention are possible. For example, the clamping rails can be movable into a raised intermediate position for transfer of the stack or stacks. The mechanisms provided for application of the adhesive closing strip on the stationary support and under the carriage each have a raisable and lowerable supporting member for a adhesive closing strip roll and an adhesive strip retaining plate movable in front of the ends of the stack projecting from the supporting member which extends in a raised position above and below the stack.

A plurality of nozzles alternatively for either compressed air or vacuum can be provided on the side of the adhesive strip retaining plate facing the adhesive closing strip.

In another feature of our invention a knife blade movable transverse to the adhesive strip retaining plate can be provided for cutting the adhesive strip in the lowered position of the adhesive strip retaining plate as part of the closing strip cutting mechanism. A paper guide or guides can be provided between the drivable supporting rollers and the press roll which is spaced radially from the stack in the lowered position of the press roll. A feed mechanism for the stacks controllable by each of the counters can be provided for the receiving troughs. This feed mechanism produces a gap for spacers insertable there between the stack and the following workpieces.

Between the ends of the receiving trough and the vicinity of the gap a return mechanism for return of the spacers is positioned. For return of the spacers a pipe running parallel to the receiving troughs and connecting ducts or shafts extending from the pipe to the receiving troughs can be provided which is associated with a plurality of piston-cylinder units as lifting and feed devices for return of the spacers.

In some forms of our invention a lowerable aligning beam is provided above the wrapping station. Advantageously then the press roll or rolls, a paper guide and the carriage movable toward the stack on the wrapping station are mounted on the aligning beam. The carriage held on the aligning beam is couplable with an additional second carriage provided under the supporting rollers in the applied position of the aligning beam. The carriage-mounted cutter for cutting away the edge of the wrapping paper and the devices for applying the adhesive closing strips travelling with the mechanism for cutting off the edge can be located on the additional second carriage.

A plurality of blower jets can be mounted longitudinally movable on the aligning beam directed toward the ends of the stack. A plurality of compressible rolls movable along the stack above the stack ends on diametrically opposite sides of the stack ends on supporting rods pivotable on the aligning beam from above to below the aligning beam can be provided for rolling on the ends of the adhesive strips and one of these supports is mounted on the movable carriage.

In the apparatus of our invention the application of the adhesive closing strip can occur above the wrapping station so that already during the application of the adhesive closing strip a new stack can be fed to the wrapping station and an increase of the cycle time of the apparatus can be attained.

This can be accomplished because the press roll and the paper guide are mounted on the raisable and lowerable supporting arm and the paper guides can be formed as gripping shells lowerable against each other to transfer the stack wrapped and provided with the adhesive closing strips applied to the stack ends into a position above the wrapping station. A plurality of compressible rolls are movable along the stack engaging on diametrically opposite sides of the stack ends in a position above the wrapping station aligned with the stack and under the raised stack a plurality of inclined pivotable straps are provided for transfer to the stack which is finished into a discharge trough laterally adjacent and above the wrapping station. The raisable and lowerable supporting arms can be guided and mounted on vertical rods which for their part are attached on a stationary support or beam provided in a region above one of the receiving troughs or on a pipe running parallel to the receiving trough for return of the spacers.

BRIEF DESCRIPTION OF THE DRAWING

The above and other objects, features and advantages of our invention will become more readily apparent from the following description, reference being made to the accompanying highly diagrammatic drawing in which:

FIGS. 10*a* and 10*b* are detailed perspective views of a mechanism for rolling on the adhesive closing strip projecting lengths in two different positions;

SPECIFIC DESCRIPTION

Figure 1:
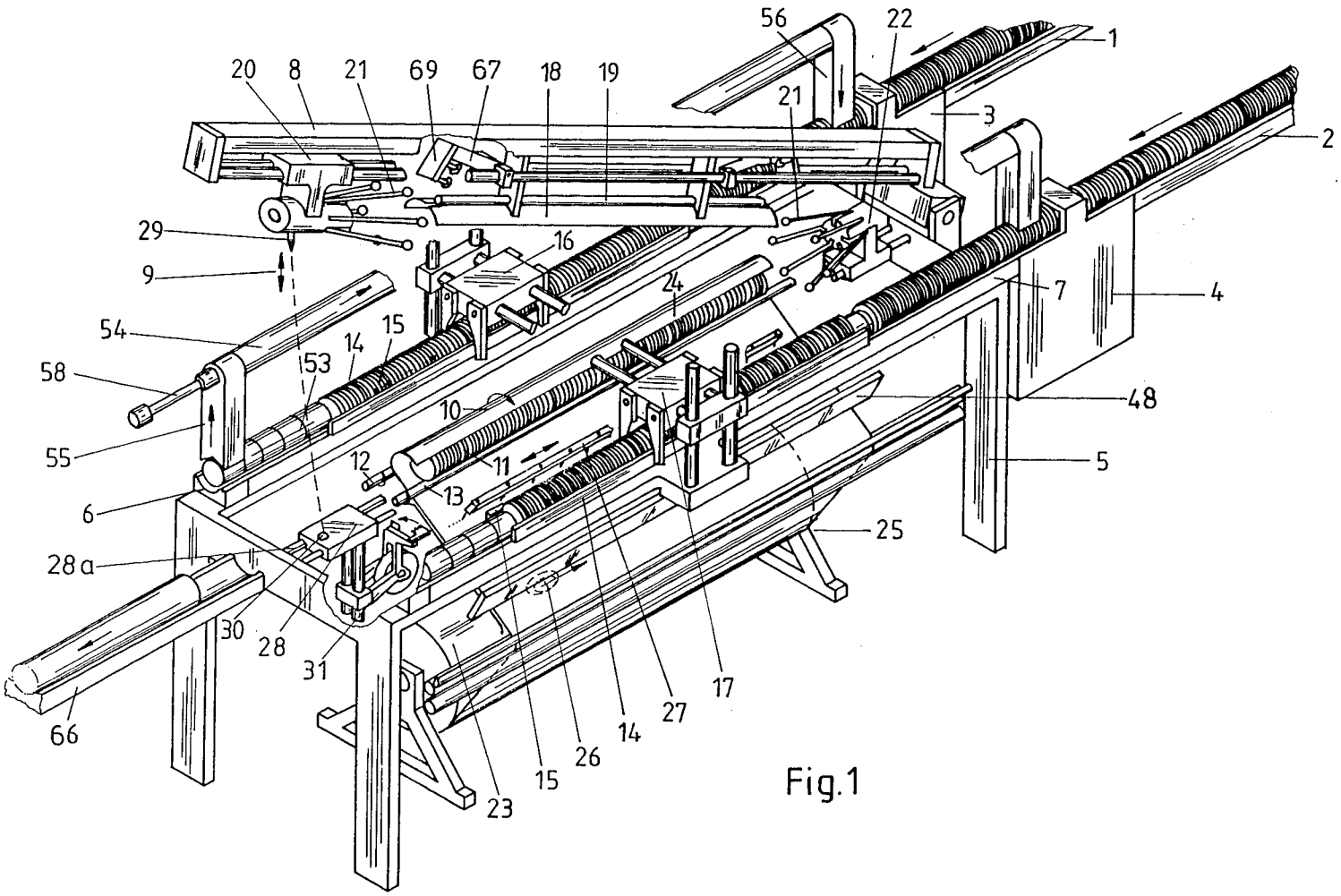
FIG. 1 is a perspective view from above of an apparatus for packaging a cylindrical stack of disk-like workpieces according to our invention with an upwardly pivotable aligning beam.

The apparatus shown in FIG. 1 is provided with two substantially parallel conveying troughs 1 and 2 which are equipped with counters 3 and 4 for the disk-like workpieces to be conveyed into the apparatus along the conveying troughs 1 and 2. In the case of the embodiments shown in the drawing the disk-like workpieces comprise covers which are divided into stacks of equal number and are wrapped in a jacket made of paper with closed ends in the apparatus of FIG. 1.

The apparatus of FIG. 1 has a frame and/or table-like stand 5 on which receiving troughs 6 and 7 which run in the longitudinal direction of the frame-like stand 5 are provided as extensions of the conveying troughs 1 and 2 for feeding the covers to be wrapped.

In the embodiment of FIG. 1 an upwardly pivotable aligning beam 8 is hingedly mounted on one side of the frame-like stand 5 which extends in the longitudinal direction centrally between the receiving troughs 6 and 7 and is movable from the upwardly pivoted position shown in FIG. 1 in the direction of the double arrows 9 into a lowered position parallel to the receiving troughs 6 and 7. A wrapping station 10 is located between the receiving troughs 6 and 7 and approximately at the same height as the receiving troughs 6 and 7 but under the aligning beam 8. In the wrapping station 10 cover stacks removed from the receiving troughs 6 and 7 are wrapped in a jacket. In the illustration a cover stack 11 is detectable.

The wrapping station 10 has two supporting rollers 12 and 13 driven about their longitudinal axes which are held in the frame-like stand 5 rotatable but locally fixed.

To transfer the cover stacks from the receiving troughs 6 and 7 to the drivable supporting rollers 12 and 13 of the wrapping station 10 opposing movable pairs of clamping rails 14 and 15 engaging both sides of the stack are associated with the receiving troughs.

The clamping rails 14 and 15 are attached to the clamping rail operating mechanisms 16 and 17 with whose help they can be moved in the clamped or released configuration into a position above the receiving troughs 6 and 7 and from this raised position in the direction of the wrapping station 10. There they can be lowered until they are positioned at the drivable supporting rollers 11 and 12.

With the help of the operating mechanisms 16 and 17 and the clamping rails 14 and 15 connected with them the individual stacks 11 can be taken from the receiving troughs 6 and 7, transferred into a raised parking and/or waiting position and from this position to the drivable supporting rollers 12 and 13 of the wrapping station 10. For this purpose the operating mechanisms 16 and 17 are equipped with pneumatically operable drive elements in a known way which cause the raising and lateral shifting motion of the clamping rails 14 and 15.

The sides of the clamping rails 14, 15 facing the cover stack 11 are equipped appropriately with an antislip and elastic coating to reliably grasp all the covers of the stack and to transfer them into the wrapping station 10 maintaining the opposing positions of the covers.

Figure 5:
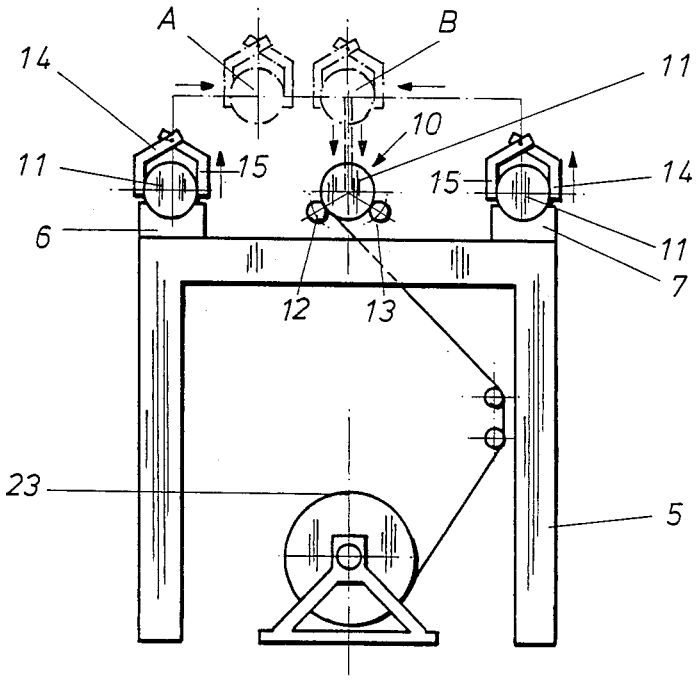
FIG. 5 is a simplified side elevational view in which the transfer of the cylindrical stack to the wrapping station is illustrated.

In FIG. 5 the path of the motion of the cover stack 11 held between the clamping rails 14 and 15 is illustrated.

The cover stack 11 gripped by the clamping rails 14 and 15 on the left portion of FIG. 5 is transferred next to the raised position A. This position is simultaneously an intermediate and a waiting position, during which the associated receiving trough 6 is already free for receiving the next cover stack.

From this position A, the cover stack 11 can be moved into the position B above the wrapping station 10 before lowering occurs from there to the drivable supporting rollers 12 and 13. The path of motion is indicated by the arrows in FIG. 5. The return motion of the clamping rails 14 and 15 occurs in reverse. The motion of the clamping rails 14 and 15 reproduced in the right portion of FIG. 5 proceeds analogously so that the cover stacks 11 can be taken alternatingly or in arbitrary sequence from the receiving troughs 6 and 7 and can be transferred to the wrapping station 10.

The aligning beam 8 is equipped according to FIG. 1 on its lower side with a paper guide 18 running in its longitudinal direction between which at least one press roll 19 is provided similarly running in its longitudinal direction. In the lowered position of the press roll 8 the press roll 8 extends parallel to the drivable supporting rollers 12 and 13.

Further a carriage 20 slidable along this beam is located on the lower side of the aligning beam 8 which is equipped with a folding fingers 21 movable into a closed and a spread configuration. Below the aligning beam 8 and at the same height as the wrapping station a fixable support 22 securable in position is provided which similarly is equipped like a carriage 20 with folding fingers 21.

The folding fingers 21 form closed rosettes on the ends of the paper jacket in a way still to be described and resulting from moving of the folding fingers 21 into the closed configuration with simultaneous rotation of the stack 11 already located in the jacket.

A supply roll 23 for the sheet of paper 24 is held in a paper dispensing unit 25 in the region under the wrapping station 10. The sheet of paper 24 is pulled from the supply roll 23 by a take-up roll not shown in FIG. 1 and guided with the help of a later to be described feed device between the drivable supporting rollers 12 and 13 and is wound around the stack 11 at the wrapping station 10 under the influence of the paper guide 18 and the press roll 19.

So that the paper web 24 can be cut into a piece required for wrapping a stack a longitudinal cutter 26 is provided which is illustrated only schematically in FIG. 1 travelling transversely to the paper web 24. Further to close the jacket the piece cut from the sheet is wound about the stack an adhesive dispensing and/or gluing dispensing mechanism is provided which in this example comprises a nozzel supporting bar 27 movable to and fro running transversely over the paper sheet 24.

An additional carriage 28 is mounted on a guide member 28*a* extending longitudinally in the frame-like support 5 in the vicinity of the movable carriage 20 provided on the aligning beam 8 directly under the drivable supporting rollers 12 and 13. This additional carriage 28 is couplable with the carriage 20 guided in it in the lowered position of the aligning beam 8. For this purpose the carriage 20 is equipped with a coupling pin 29 which engages in a suitable hole 30 of the additional carriage 28.

The additional carriage 28 is equipped with a carriage-mounted cutter not shown in FIG. 1 for cutting the edge of the paper sheet 24 and with a mechanism 31 for applying the adhesive closing strip with a closing strip cutting mechanism associated with it. In the vicinity of the support 2 a similar mechanism for applying the adhesive closing strip with associated closing strip cutting mechanism corresponding to the mechanism 31 which is similarly not shown in FIG. 1 and which is not adjustable during operation is provided.

Figure 2:
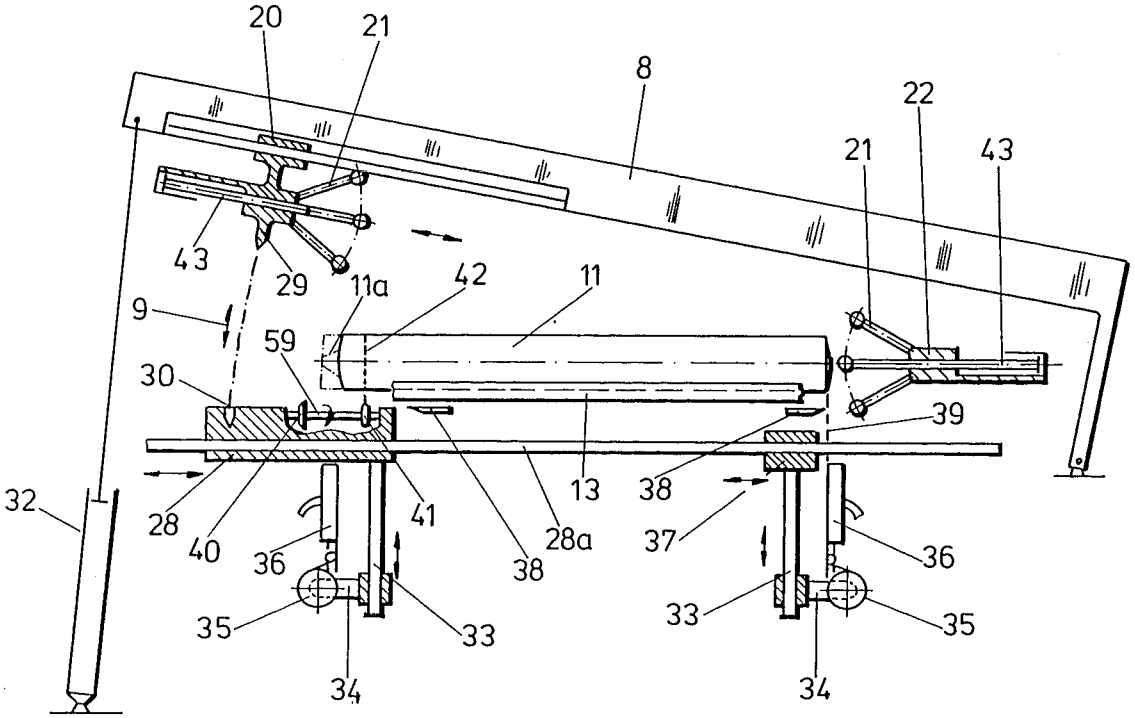
FIG. 2 is a purely diagrammatic partial side elevational view of the apparatus of FIG. 1.

In the schematic drawing the mechanisms for applying the adhesive closing strip with the associated closing strip cutting mechanisms are apparent from FIG. 2. In this figure the parts corresponding with those of FIG. 1 are provided with the same reference numbers.

In FIG. 2 the aligning beam 8 can be moved into a raised or lowered position along the double arrows 9 and can be applied to cause a predetermined pressure on the cover stack 11 to be wrapped.

In regard to the mechanisms for applying the adhesive closing strips, FIG. 2 shows that a guide rod 33 directed downwardly is mounted on the additional carriage 28 under the wrapping station 10 which receives or supports a raisable and lowerable supporting member 34 for an adhesive closing strip roll 35. An adhesive strip retaining plate 36 running parallel to the guide rod 33 projects from the supporting member 34. This adhesive strip retaining plate 36 is guidable with the supporting member 34 in its motion along the guide rod 33 into a position directly in front of the front side 11*a* of the already wrapped cover stacks 11 provided with a rosette and is returnable again into the position reproduced in FIG. 2.

In the same way in the region below the support 22 a mechanism comprising the same parts 33 to 36 is provided for application of the adhesive closing strip whose guide rod 33 projecting downwardly is connected with a guide piece 37 held locally fixed on the guide member 28*a* for the additional carriage 28 during operation of the apparatus.

In FIG. 2 the closing strip cutting mechanisms provided for cutting through the adhesive closing strip are only indicated with a knife blade or cutting blade 38 movable transversely to the adhesive strip 39.

FIG. 2 shows further the carriage 28 with a carriage-mounted cutter for cutting off the carriage-side edge of the paper sheet 24. For this purpose a cutting blade or wheel 40 is provided in the additional carriage 28 on a shaft 59 drivable along the carriage.

Further a perforating tool 41 rotating with this shaft is also mounted on the shaft 59. The perforating tool 41 provides a round perforation 42 in the paper sheet wrapped on the stack 11 spaced from and parallel to the edge of the paper sheet 24 to be cut off.

Finally FIG. 2 shows that a pressure-limiting contacting member 43 is provided both in the carriage 20 mounted longitudinally movable on the aligning beam 8 and also on the support 22 so that the pressure-limiting contacting member 43 on the carriages 20 determines the thrust of the carriage 20 against the cover stack 11 located on the drivable supporting rollers 12 and 13. The pressure-limiting contacting member 43 of the locally fixed support 22 is acted on with a higher pressure than the other pressure-limiting contacting member 43 of the carriage 20 so that it practically acts as a locally fixed support.

The same pressure is exerted by the pressure-limiting contacting member 43 on the carriage 20 on the cover stack 11 independently of its length so that the cover stack to be wrapped has the same packing density and correspondingly longer and/or shorter stacks arise with large thickness tolerances. By the carriage-mounted cutter provided on the additional carriage 28 independently of the length of the stack the edge of the paper sheet 24 adjacent the carriage 28 is cut off far enough from the stack end so that it is still possible to form a rosette. Also the line of perforations is punched with the same spacing from the end of the cover stack.

Figure 4:
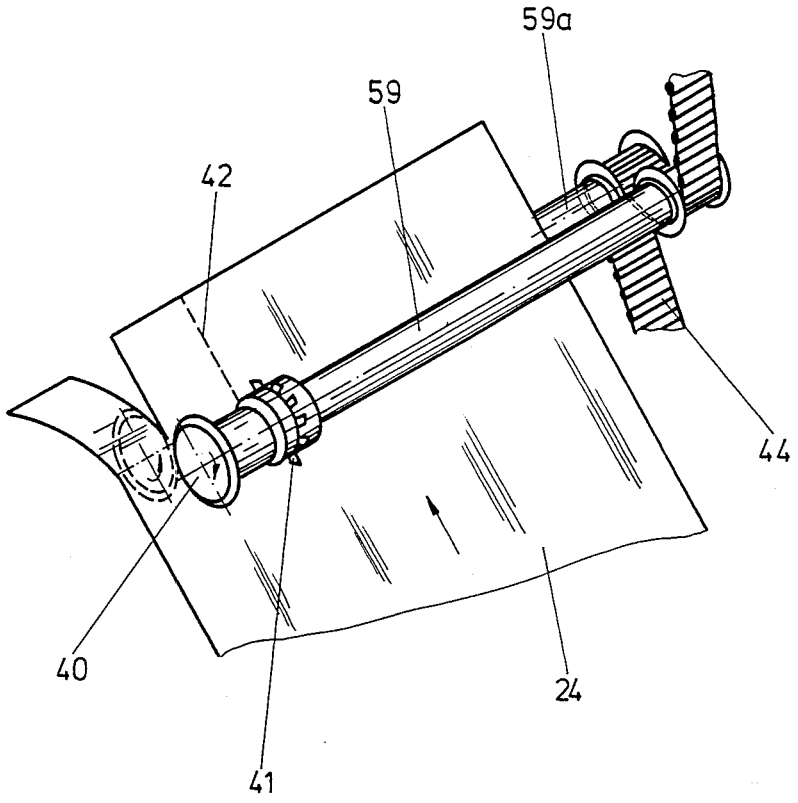
FIG. 4 is a perspective view of a cutter for the longitudinal edge of the paper forming the jacket, i.e. (the transverse edge of the paper on the stack) which is not reproduced in FIG. 3.

The carriage-mounted cutter (including shaft 56 and cutting wheel or blade 40) for cutting off the edge of the paper sheet is shown in detail in FIG. 4 however without the additional carriage 28 on which it is mounted and which surrounds it being reproduced. Also here the same parts are provided with the same reference numbers.

One sees that the paper sheet 24 is guided through and between two driven shafts 59 and 59*a*. Toothed belt drive 44 acts to drive the shafts 59 and 59*a*. The associated drive motor can be provided on or in the additional carriage 28, for example in the form of a hydraulic motor.

Figure 3:
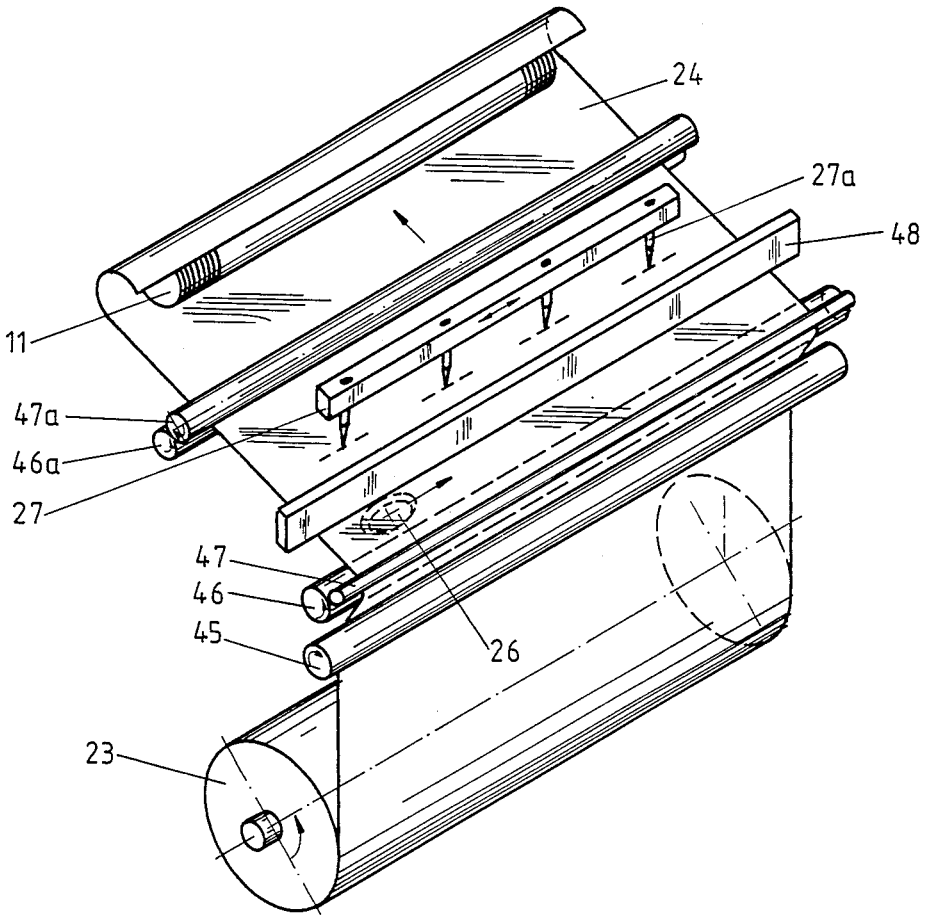
FIG. 3 is a diagrammatic perspective view illustrating the principle used for feeding the paper to form a jacket about the stack of disk-like workpieces in the apparatus according to FIG. 1.

The feed of the paper sheet 24 from the supply roll 23 to the cover stack 11 is shown schematically, but in detail, in FIG. 3.

The sheet 24 is guided over a guide roll 45 and between driven cooperating tensioning rolls 46 and 47 and additional rolls 46*a* and 47*a*. Between the previously-mentioned roll pairs guides are provided which are not shown in the drawing.

The cutting mechanism provided for cutting off the pieces of paper for wrapping the stack transversely has a cutting beam 48 cooperating with the cutting wheel 26.

FIG. 3 clearly shows the glue applying mechanism in the form of the nozzel supporting bar 27 with the adhesive nozzles 27*a* mounted on it for gluing the ends of the paper together around the stack.

The cover stacks 11 moved into the wrapping station 10 are acted on by blower jets 65 on their ends after their transfer to the wrapping stations 10 until contact with the pressure-limiting contacting member 43. As is illustrated the blower jets 65 in FIG. 6 for a stack 11 are mounted in the vicinity of the drivable supporting rollers 12 and 13. The blower jets 65 can be held longitudinally slidable adjacent the aligning beam 8 to adjust them to the length of the stack 11.

Figures 7A, 7B, 7C, 7D:
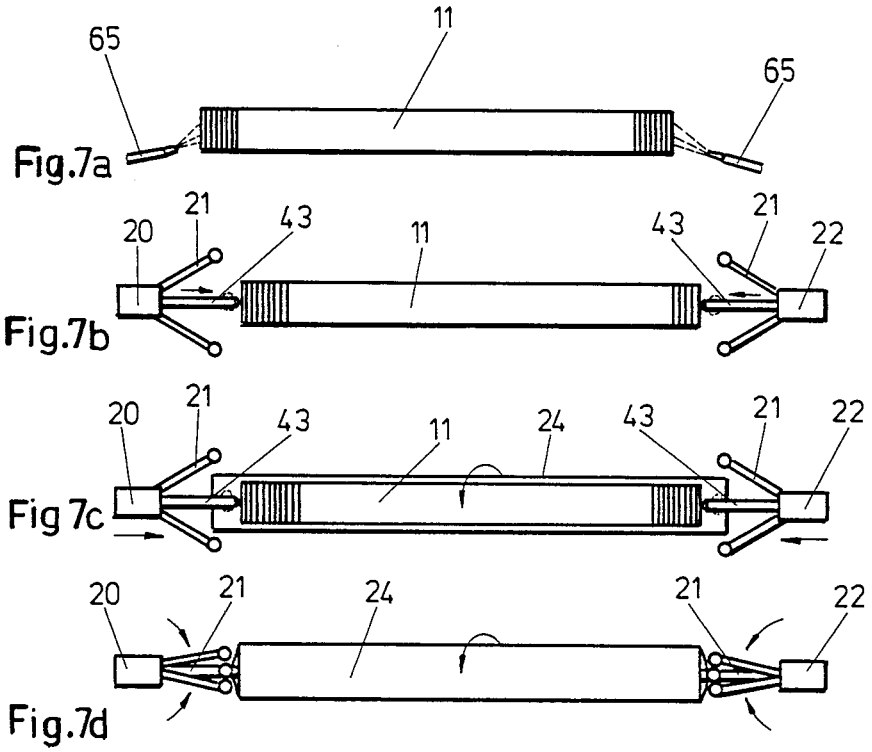
FIGS. 7*a* to 7*d* are action views showing various steps of the winding process.

The form of the rosettes on the ends of the jacket formed by the paper sheet 24 is illustrated from FIG. 7 which shows schematically the individual steps of the wrapping process.

Figure 6:
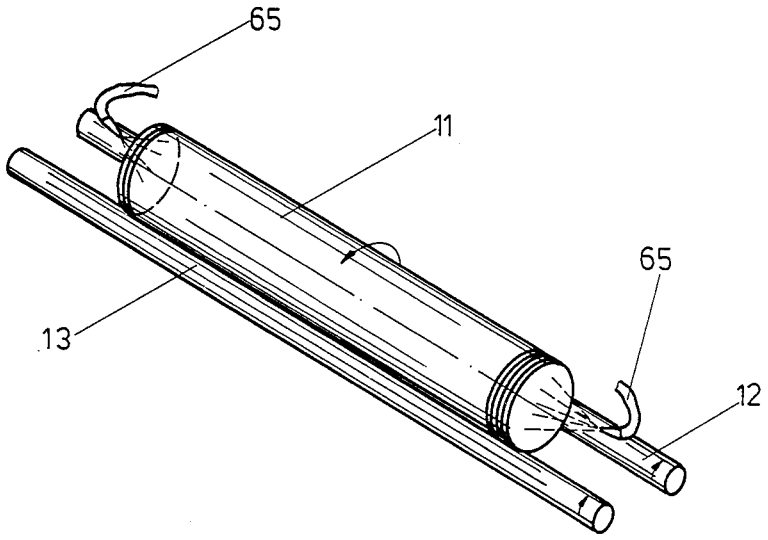
FIG. 6 is a partial perspective view of a stack in the wrapping station prior to the wrapping process.

In step a the ends of the cover stack 11 illustrated in FIG. 6 are acted on by the blower jets 65 so that the covers cannot fall over at the ends of the stack.

In step b the carriage 20 is moved forward with spread folding fingers 21 with its pushed forward pressure-limiting contacting member 43 against the stack 11 and has pressed the stack 11 against the pressure-limiting contacting member 43 of the support 22 so that it is moved into the correct position in regard to the paper sheet 24 and is wrapped or jacketed by feed the paper sheet 24 maintaining an axial pressure as is illustrated in step c. During the further rotation of the cover stack 11 already provided with the surrounding jacket, the folding fingers 21 are now moved into the closed position according to step d so that the folding fingers cooperate with the facing protruding lengths of the jacket so that a rosette is folded. In the final portion of the step of the cooperative guiding of the fold fingers the pressure-limiting contacting member is moved into its initial position.

Figure 8:
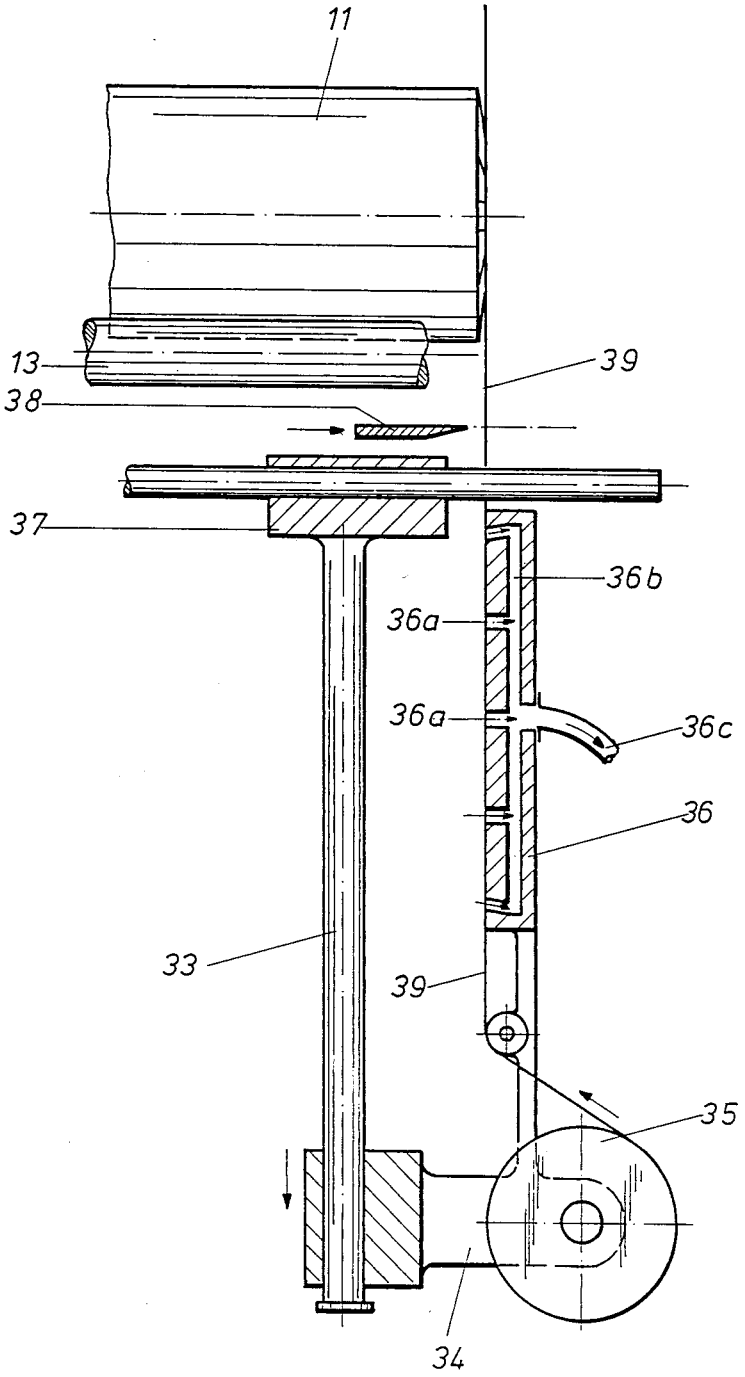
FIG. 8 is a partial side plan view of a mechanism for applying the adhesive strip to close the jacketed stack.
Figure 9:
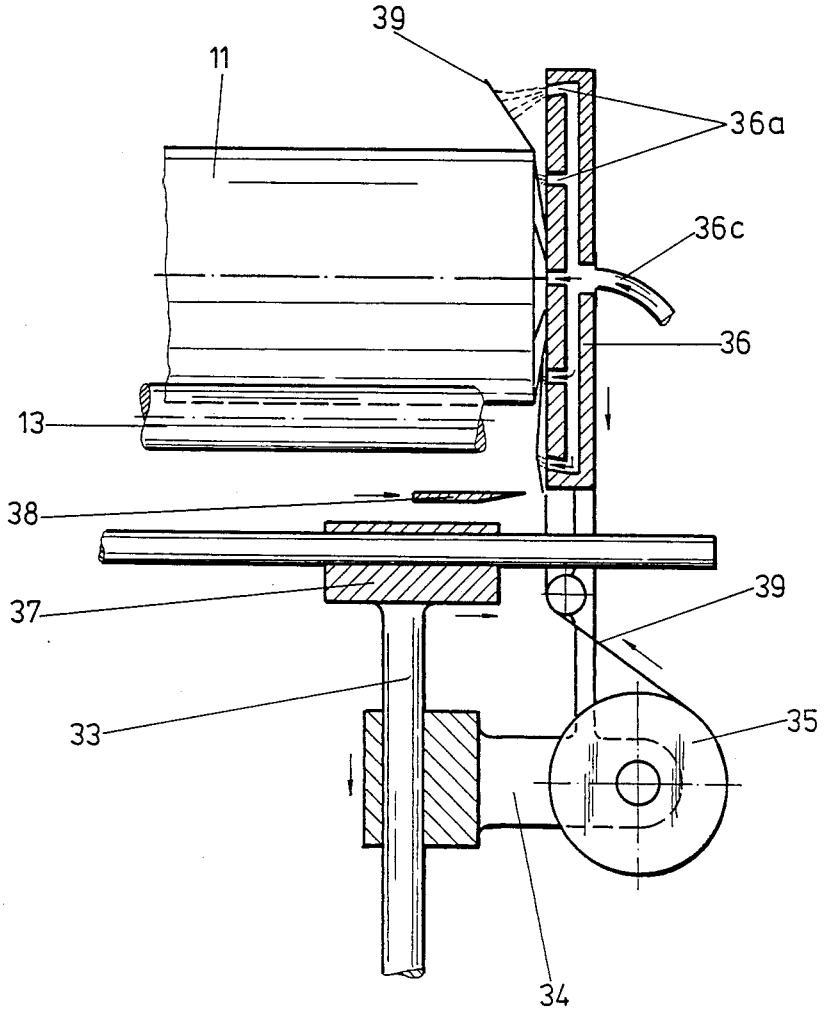
FIG. 9 is a partial side plan view of the mechanism shown in FIG. 8 in another configuration.

The subsequent application of the adhesive closing strip 39 is shown in a partial illustration in FIG. 2 and for two different positions of the adhesive strip retaining plates 36 in FIGS. 8 and 9.

FIGS. 8 and 9 show the mechanism for application of the adhesive closing strip 39 in the vicinity of the support 22 in FIG. 2.

In FIG. 8 the adhesive strip retaining plate 36 is shown in its lowered initial position. The adhesive strip retaining plate 26 has nozzle openings 36*a* which are combined with a common feed duct 36*b* which is connected to a supply pipe 36*c* by which a pressurized air and/or vacuum source are connected alternatingly.

In the position reproduced in FIG. 8 of the adhesive closing strip retaining plate 36, an evacuation of the nozzle openings 36*a* occurs so that the piece of the adhesive closing strip located in front of the retaining plate 36 is pressed on the retaining plate 36. The adhesive closing strip 39 is coated with adhesive material on its side facing away from the retaining plate 36. The piece of the adhesive closing strip 39 extending above the retaining plate 36 adheres with its adhesive layer on the rosette on the end of the jacket of the cover stack 11.

By operation of the closing strip cutting mechanism shown as a moving blade 38 the piece of the adhesive closing strip 39 located above the retaining plate 36 is cut away and the projecting ends of these pieces are laid on the jacket of the stack 11 and are pressed there in a way which is still to be described. During the application of the adhesive closing strip 39 the cover stack 11 provided with the jacket is at rest, it is no longer set in rotation by the driven supporting rollers 12 and 13. After applying the adhesive closing strip 39 to the facing ends of the jacketed cover stack 11 the finished cover stack is pushed in the longitudinal direction from the wrapping station 10 from the apparatus according to FIG. 1 and reaches a discharge trough 66 shown in FIG. 1.

After the next cover stack 11 is formed in the wrapping station 10 with its jacket and rosettes, the adhesive strip-retaining plate 36 is moved from the position shown in FIG. 8 maintaining the suction on the nozzle openings 36*a* in the position illustrated in FIG. 9 and in this position then instead of suction being provided at the nozzle openings 36*a* pressurized air is supplied, as is indicated by the arrows in FIG. 9.

In this way, the piece of the adhesive closing strip 39 located in front of the retaining plate 36 is pressed against the rosette and holds it fixed. The upper ends of the adhesive strip piece 39 is thus already inserted the direction of the cover stack. With the following downward motion of the retaining plate an additional piece of adhesive strip 39 is drawn from the adhesive roll 35 for transfer into the position according to FIG. 8 and the piece located in front of the retaining plate 36 again is acted on with suction through the nozzle openings 36*a*, as is already described in connection with FIG. 8.

The support 67, downwardly pivotable from above on the aligning beam 8 and/or on the movable carriage 20, can be provided with compressible end rollers 68 movable over the stack ends on diametrically opposite sides of the stack which are mounted on additional roller carriage 69 which travels back and forth along the support rods 67 to roll on the protruding ends of the adhesive strip 39 on the circumferential surface of the jacket of the cover stack 11.

In FIG. 10*a* the initial position of the compressible end rollers 68 is shown, and in FIG. 10*b* in which the final position is shown, the end rollers 68 roll on the protruding ends of the adhesive closing strips 39 on the circumferential surface of the jacket of the stack 11.

Figures 13A, 13B, 13C:
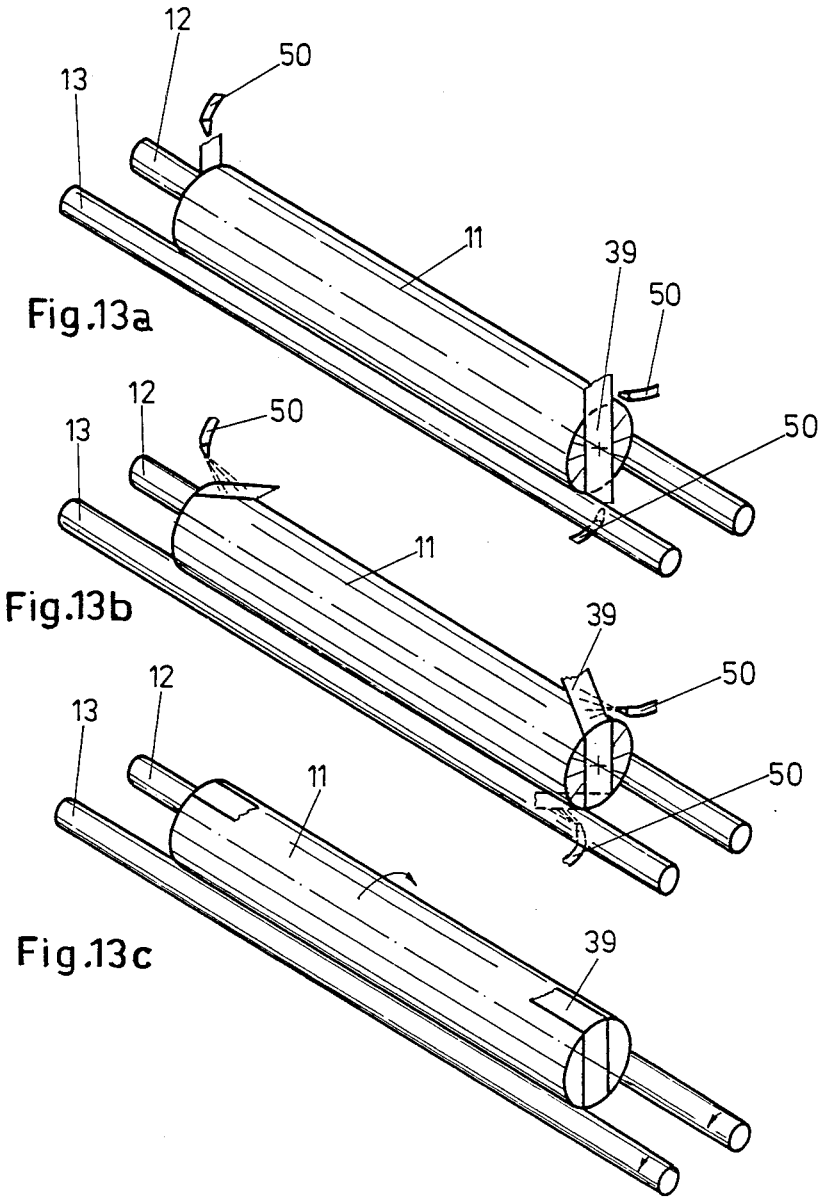
FIGS. 13*a* to 13*c* are perspective schematic action views showing the steps a to c of the blowing and rolling on of the adhesive strip projecting lengths.

Instead of this described type of application of the ends of the adhesive closing strip 39 according to FIG. 13, the protruding ends of the adhesive strip can be acted on by additional blower nozzels 50 so that they are moved from the step a reproduced in FIG. 13 by the step b into the configuration according to step c and attain an adhesive contact with the jacket of the stack 11. The rolling on can then be effected in step c by a fresh rotational motion of the cover stack by the drivable supporting rollers 12 and 13.

One desires to attain a circumferential loose jacket for the cover stack 11 which has the value that the covers can be easily removed after opening the jacket. That can be seen in the schematic illustration in FIG. 11.

Figure 11B:
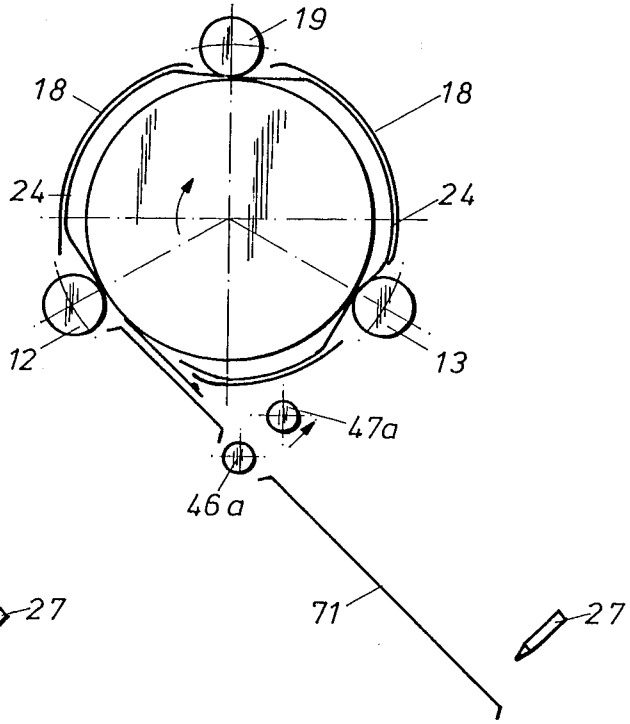
FIG. 11*a* and 11*b* are action views of two steps a and b at the beginning and the end of the wrapping process to form a loose jacket on the stack.
Figure 11A:
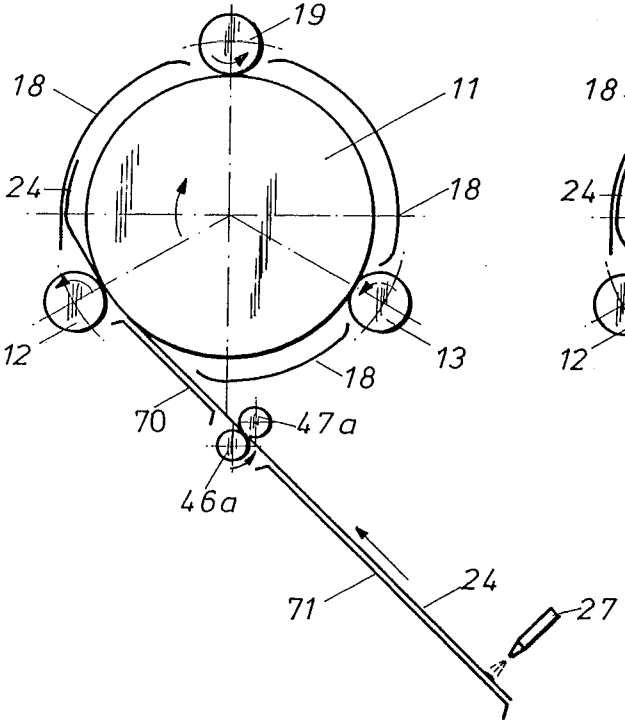

In FIG. 11*a* the beginning of the wrapping of the stack 11 is shown while on the right of FIG. 11*b* the situation immediately before the ending of the wrapping process is shown.

The cover stack 11 is placed in the wrapping station 10 on the drivable supporting rollers 12 and 13, on which it is pressed by the press rolls 19 of the lowered aligning beam 8. The paper sheet 24 for wrapping the stack 11 is guided along the guide plates 70 and 71 shown in FIG. 11 and through the drivable roll pair 46*a* and 47*a* in the space between the drivable supporting rollers 12 and the stack 11.

The stack 11 is surrounded by paper guide plates 18 running with radial spacing around the stack with the aligning beam 8 lowered. Also a paper guide 18 is provided in the region below the drivable supporting rollers 12 and 13.

In the wrapping process, the inserted paper sheet 24 is guided in the region outside of the supporting rollers 12, 13 and press roll 19 along the inner wall surfaces of the paper guide 18 so that a loose jacket is produced in the right FIG. 11*b*.

In the step a shown in FIG. 11*a* the time for glue application on the end edge of the paper sheet is indicated which is caused with the help of the already described nozzle beams 27.

Figure 12:
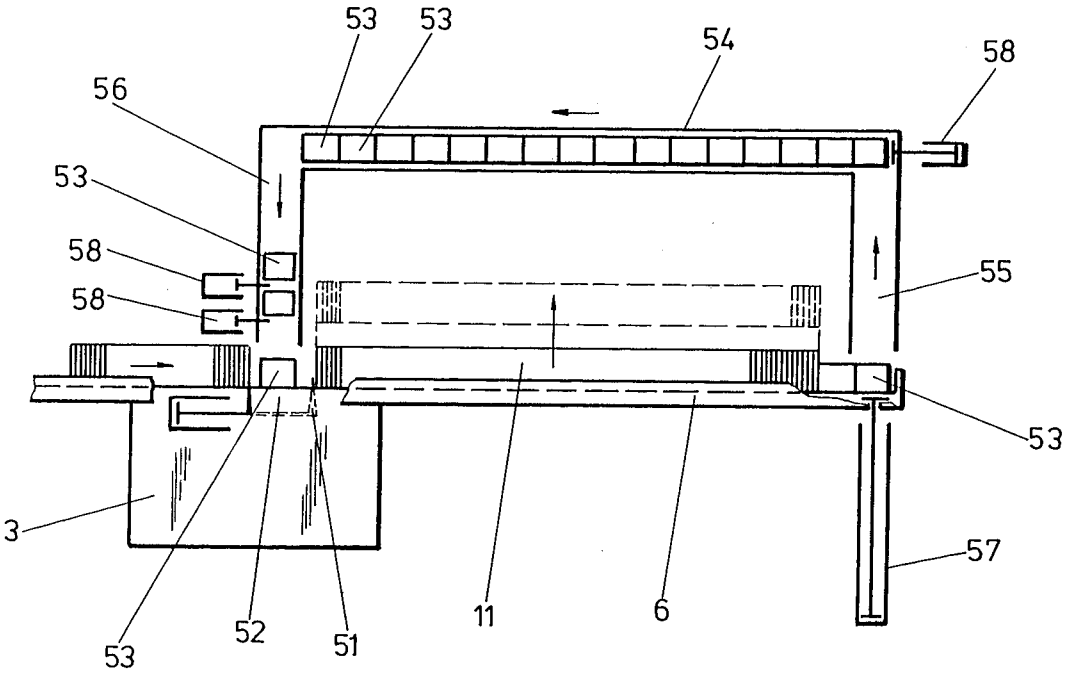
FIG. 12 is a simplified side view of a return mechanism for the spacers inserted between successive stacks.

To separate the individual stacks fed from the conveying troughs 1 and 2 from each other so that a space is maintained from the following covers of the next stack, a feed mechanism controllable from the counters 3 and 4 for the stack comprising the counted covers is provided in connection with the mechanism for inserting spacers which is shown schematically in FIG. 12 and partially also in FIG. 1.

According to FIG. 12, the counter 3 reproduced there is provided with a feed mechanism 51 controllable by it which feeds the covers of the stack 11. On attaining the desired number of covers so that a gap 52 arises between the stack 11 and the next following set of covers. In this gap one or more cylindrical spacers 53 are brought in which are smaller than the covers so that they are not inserted the wrapping station 10 from the receiving trough 6 and/or 7 on transferring the cover stack 11.

The spacers 53 remaining in the receiving troughs 6 and/or 7 are returned from the ends of the receiving troughs 6 and/or 7 again in the vicinity of the gap 52. For this purpose a pipe 54 running parallel to the receiving troughs 6 and/or 7 in a space above the receiving troughs is provided and connected with connecting shafts 55 and 56 to the appropriate places at the ends of the receiving troughs 6 and 7.

The spacers 53 arriving at the ends of the receiving troughs 6 and/or 7 are guided in the pipe 54 by a piston-cylinder unit 57 and there by an additional piston-cylinder unit 58 are fed further in the direction of the beginning of the receiving troughs 6 and/or 7 as is indicated by the arrows. In the connecting shaft 56 controllable stops in the form of piston-cylinder units are provided which are operated by the feed mechanism 51 so that after formation of the gap 52 one or more spacers 53 for insertion in the gap 52 is released.

The mechanisms reproduced schematically in FIG. 12 are similarly partially indicated in FIG. 1 above the receiving trough 6.

Figure 14:
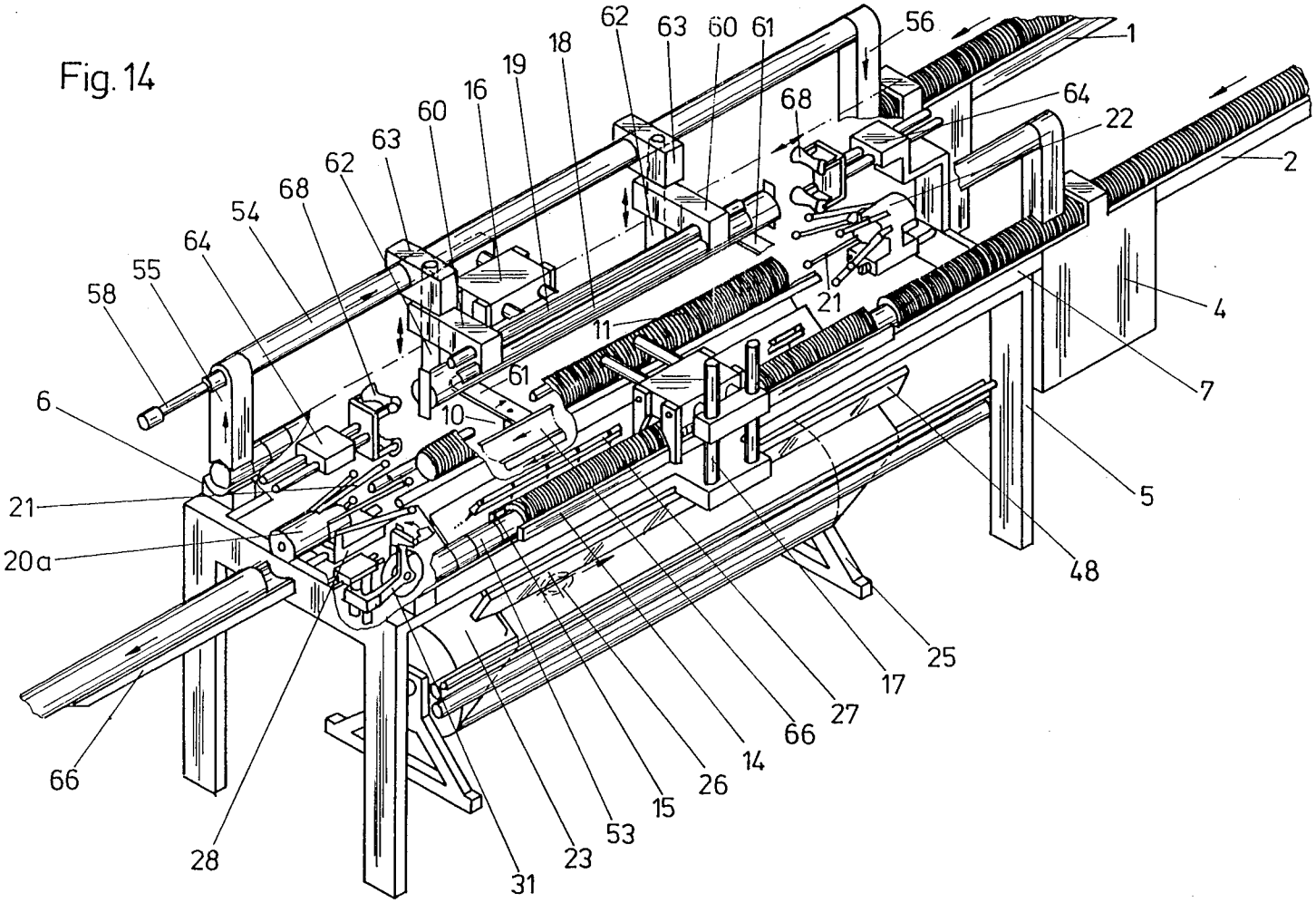
FIG. 14 is a top perspective view of another embodiment of the apparatus shown in FIG. 1 in which the aligning beam and the paper guide are mounted on raisable and lowerable supporting arms.
Figure 15:
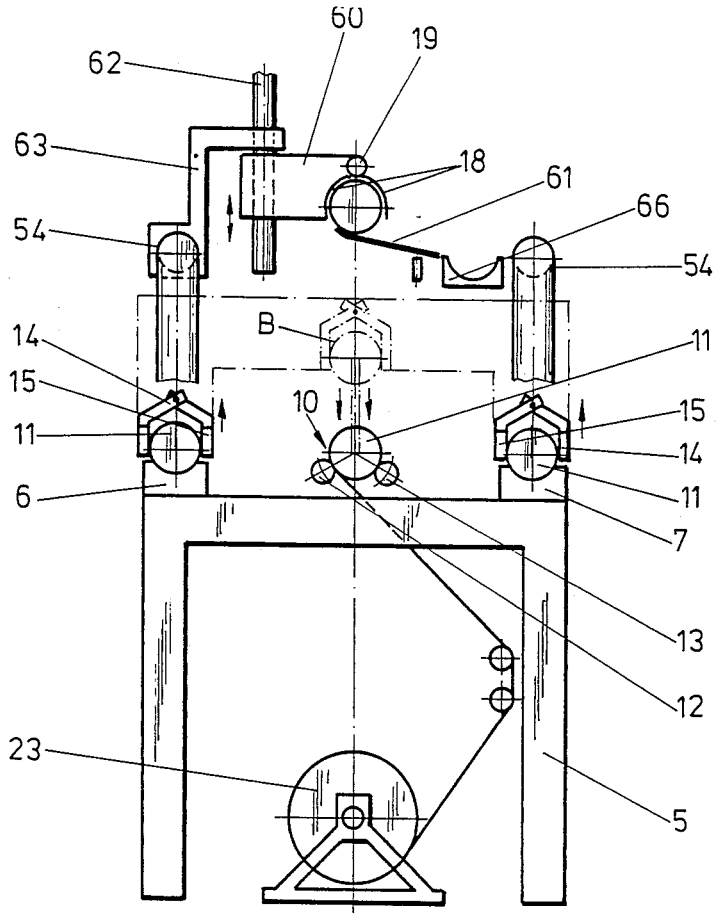
FIG. 15 is a simplifed side view corresponding to FIG. 5 for the embodiment shown in FIG. 14 in which the transfer of the stack to individual positions is illustrated.

FIGS. 14 and 15 show another embodiment of our invention differing from that of FIG. 1 in which the essential difference is that in the design according to FIGS. 14 and 15 no aligning beam with mounting elements on it is provided. In FIGS. 14 and 15 the parts corresponding to those in the other FIGURES are also provided with the same reference numbers.

Instead of the aligning beam 8 shown in FIG. 1 with the press rolls 19 and paper guides 18 mounted on it raisable and lowerable supporting arms 60 are provided in the embodiment according to FIGS. 14 and 15 on which the press rolls 19 and the paper guides 18 are mounted. The supporting arms 60 which are like brackets are mounted on the lifting and/or guide rods 62, which are attached to the pipe 54 for the return of the spacers 53 running parallel to the receiving trough 6 in the illustrated example by intermediate pieces 63. The supporting arms 60 extend like brackets until they lie above the wrapping station 10 and are raisable in the direction of the double arrows along the vertical guide rods 62 or jointly with them so far that in the lowered position the press rolls 19 contact on the cover stack 11 located in the wrapping station 11 and in the raised position the feed of an additional cover stack from one of the receiving troughs 6 and/or 7 by the opposing movable clamping rails 14 and 15 in the previously described way is not prevented.

In the apparatus of FIGS. 14 and 15, the paper guides 18 mounted on the supporting arms 18 are simultaneously constructed as gripping shells and connected with an unshown operating mechanism so that they can be moved into a clamped position from a position in which they surround the stack to be wrapped with spacing to grip the stack provided with the adhesive closing strips and wrapped in the wrapping station 10 and to move the stack into the lifted position by the upward motion of the supporting arms 60. Since the rolling on of the adhesive closing strips should be effected in this raised position, the compressible end rollers 68 movable longitudinally which are pivotally mounted on the aligning beam 8 in the embodiment of FIG. 1 are mounted on a locally fixed guide carriage 64 and can travel back and over the stack ends for rolling on the adhesive closing strips in the way described earlier with their compressible end rollers 68 by a drive not reproduced in the drawing.

The rolling on of the adhesive closing strips on the wrapped stack occurs thus in the embodiment according to the FIGS. 14 and 15 no longer in the wrapping station 10 but with the wrapped stack above this wrapping station. Thus the wrapping station 10 can be supplied with a new cover stack during the rolling on of the adhesive closing strips.

To remove the cover stack provided with the rolled on adhesive closing strip without hindering the next wrapping process, pivotable straps 61 are provided under the cover stack located in the raised position. After release of the cover stack by spreading the paper guide 18 the stack can roll over the pivotable straps 61 into the discharge trough 66 above the wrapping station and now laterally differing from FIG. 1, from which it can be conveyed further by an unshown ejection mechanism.

The carriages 20 movable on the aligning beam in FIG. 1 are united with the additional carriage 28 in the example according to FIGS. 14 and 15 and comprises the structural part 20*a* shown in FIG. 14 which is equipped with the folding fingers 21 and a pressure-limiting contacting member like the carriage 20, as was described previously in connection with the carriages 20.

FIG. 15 shows the upper position of the supporting arms 60 and the arrangement of the inclined pivotable straps 61 and the discharge trough provided laterally above the wrapping station 10. In the illustrated example the inclined pivotable straps 61 are hingedly connected to the discharge trough 66. One sees from FIG. 15 that in the raised position of the supporting arms 60 the wrapping station 10 can be provided directly with a fresh stack from one of the receiving troughs 6 and/or 7.

Insofar as differences in operation and function of the apparatus according to FIGS. 14 and 15 are not set forth, they work in the same way as the apparatus according to FIG. 1 and the associated individual illustrations.

By electronic circuitry not illustrated in the drawing the individual motions occuring and their consequences are controlled. Piston-cylinder units are provided predominantly for moving the individual parts of the apparatus, although the apparatus is not limited to the use of these drive members.

The "mechanism for applying an adhesive closing strip to the ends of the jacket" in the following claims corresponds to the mechanism 31 and the similar other mechanism for the other end of the stack. The "mechanism for transferring the stack or stacks into the wrapping station" mentioned in the following claims corresponds to the operating mechanisms 16 and 17 and the clamping rails 14 and 15 of the previous embodiments. The "mechanisms for rolling out, feeding, cutting and gluing the paper" named in the following claims correspond to the cutting beam, the cutting wheel 26 and the nozzles 27*a* among other components.

Our invention is not intended to be limited to the details provided above and it will be understood that various omissions, modifications, substitutions and changes in the forms and details of the device illustrated and in its operation can be made by those skilled in the art without departing in any way from the spirit of our present invention.

We claim:

1. In an apparatus for packing cylindrical stacks of a plurality of disk-like workpieces positioned beside each other, especially metal covers, in a jacket of paper, comprising one or two conveying troughs with an associated counter for feeding and guiding said workpieces, a wrapping station laterally adjacent said conveying trough or troughs, mechanisms for rolling out, feeding, cutting and gluing said paper, a mechanism for transferring said stack or stacks into said wrapping station, a folding mechanism for closing the ends of said jacket and a mechanism for applying an adhesive closing strip to said ends of said jacket which are now folded, the improvement wherein a receiving trough or troughs are provided as an extension of said conveying trough or troughs and clamping rails movable toward each other engagable on said stack are raisable and lowerable to transfer said stack to said wrapping station and are maintained laterally movable in a raised position, said wrapping station has drivable supporting rollers for support of said stack and above said supporting rollers at least one lowerable press roll running parallel to said supporting rollers on said stack and a carriage movable toward said stack in said wrapping station with a pressure-limiting contacting member for contacting the stack ends and for pressing said stack against a stationary support are provided, said carriage and said stationary support having a plurality of folding fingers for forming closed rosettes of said wrapping paper and a carriage-mounted cutter moving with said carriage for cutting away the carriage-side edge of said wrapping paper.

2. The improvement defined in claim 1 wherein said wrapping station is mounted above said mechanisms for rolling out, feeding, cutting and gluing said paper and another additional mechanism for applying said adhesive closing strip with an associated closing strip cutting mechanism is provided under said stationary support and under said carriage travelling with said carriage.

3. The improvement defined in claim 1 wherein said mechanism for cutting off said edge of said wrapping paper is equipped with a perforating tool perforating said paper spaced from and parallel to said edge.

4. The improvement defined in claim 1 wherein said clamping rails are movable into a raised intermediate and waiting position for transfer of said stack or stacks.

5. The improvement defined in claim 2 wherein said mechanisms for application of said adhesive closing strip provided on said stationary support and under said carriage each have a raisable and lowerable supporting member for an adhesive closing strip roll and an adhesive strip retaining plate movable in front of said stack ends projecting from said supporting member, which extends in a raised position above and below said stack and a plurality of nozzles for either compressed air or vacuum alternatively are provided on the side of said adhesive strip retaining plate facing said adhesive closing strip.

6. The improvement defined in claim 5 wherein knife blades movable transverse to said adhesive strip retaining plate are provided for cutting said adhesive closing strip in a lowered position of said adhesive strip retaining plate.

7. The improvement defined in claim 1 wherein between said drivable supporting rollers and said press roll a paper guide is provided which is spaced radially from said stack in a lowered position of said press roll.

8. The improvement defined in claim 1 wherein a feed mechanism for said stacks controllable by each of said counters is associated with said receiving troughs, said feed mechanism producing a gap for spacers insertable there between said stack and the following one of said workpieces and between the ends of said receiving trough and the vicinity of said gap a return mechanism for recycling of said spacers is positioned.

9. The improvement defined in claim 8 wherein for return of said spacers a pipe running parallel to said receiving troughs and connecting ducts or shafts extending from said pipe to said receiving troughs is provided which is associated with a plurality of piston-cylinder units used as lifting and feed devices for return of said spacers.

10. The improvement defined in claim 1 wherein an aligning beam lowerable to said stack is provide above said supporting rollers, on which said press roll or rolls, a paper guide or a plurality of said paper guides and said carriage movable toward said stack in said wrapping station are mounted, said carriage held on said aligning beam is couplable with an additional second carriage provided under said supporting rollers in the position of said aligning beam applied to said stack, and said carriage-mounted cutter for cutting away said edge of said wrapping paper and said devices for applying said adhesive closing strips travelling with said mechanism for cutting away said edge are located on said additional second carriage.

11. The improvement defined in claim 10 wherein a plurality of blower jets directed toward said stack ends are mounted movable longitudinally on said aligning beam.

12. The improvement defined in claim 11 wherein a plurality of compressible end rollers movable along said stack over said stack ends on diametrically opposite sides of said stack supported on a support pivotable downwardly so that said compressible end rollers can engage said stack are provided for rolling said adhesive strip on said stack ends and one of said supports is mounted on said carriage.

13. The improvement defined in claim 1 wherein said press roll and said paper guide are mounted on raisable and lowerable supporting arms and said paper guides are formed as gripping shells pivotable toward each other to transfer said stack wrapped and provided with said adhesive closing strips applied to said stack ends into a position above said wrapping station so that a plurality of compressible end rollers are movable along said stack engaging on said stack ends on diametrically opposite sides above said wrapping station aligned with said stack and engaged with said stack which is raised, a plurality of inclined pivotable straps being provided for transfer of said stack which is finished into a discharge trough laterally adjacent and above said wrapping station.

14. The improvement defined in claim 13 wherein said raisable and lowerable supporting arms are guided and held like brackets on vertical guide rods which for their part are attached on a stationary beam provided in a region above one of said receiving troughs or on a pipe running parallel to said receiving trough for return of said spacers for said stacks.

15. An apparatus for packing cylindrical stacks of a plurality of disk-like workpieces, particularly covers, positioned beside each other with equal numbers of workpieces, in a jacket made of paper comprising:

one or two conveying troughs with an associated counter for feeding and guiding said workpieces;

at least one receiving trough for receiving said stacks one-at-a-time;

a wrapping station laterally adjacent said receiving trough with drivable supporting rollers for said stacks;

two clamping rails movable laterally into a raised position and raisable and lowerable as well as movable toward each other for transferring said stacks into said wrapping station provided laterally beside said receiving trough;

at least one pressing roll running parallel to said supporting rollers lowerable in said wrapping station to said stack;

means for rolling out, feeding, cutting and gluing said paper;

a perforating tool perforating said paper spaced from and parallel to an edge of said paper;

a longitudinally movable carriage having a folding mechanism with folding fingers for closing the ends of said jacket and provided with a pressure-limiting contacting member for pressing said stack against a fixed support which also has one of said folding mechanisms for closing said ends of said jacket;

means for applying adhesive closing strips to said ends of said jacket which are folded; and a carriage-mounted cutter for cutting away said edge of said paper wrapped around said stack mounted on said carriage.

* * * * *